US006990772B2

(12) United States Patent
Eckel et al.

(10) Patent No.: US 6,990,772 B2
(45) Date of Patent: Jan. 31, 2006

(54) AUTOMATIC DOOR CLOSURE FOR DOUBLE-ACTING DOORS

(75) Inventors: Alan Eckel, P.O. Box 152, Westford, MA (US) 01886; Bryce Larrabee, Harvard, MA (US)

(73) Assignee: Alan Eckel, Westford, MA (US)

( * ) Notice: Subject to any disclaimer, the term of this patent is extended or adjusted under 35 U.S.C. 154(b) by 186 days.

(21) Appl. No.: 10/454,894

(22) Filed: Jun. 5, 2003

(65) Prior Publication Data

US 2004/0244293 A1 Dec. 9, 2004

(51) Int. Cl.
*E05F 1/04* (2006.01)
*E05D 7/00* (2006.01)

(52) U.S. Cl. ..... 49/236; 49/237; 16/316

(58) Field of Classification Search ..... 49/236, 49/237, 238, 326; 16/309, 310, 312, 316
See application file for complete search history.

(56) References Cited

U.S. PATENT DOCUMENTS

| | | | | | |
|---|---|---|---|---|---|
| 424,088 | A | * | 3/1890 | Booraem | 49/1 |
| 454,343 | A | * | 6/1891 | Gibson | 16/318 |
| 1,845,477 | A | | 2/1932 | Bommer | |
| 2,840,848 | A | | 7/1958 | Hickey | |
| 3,107,758 | A | * | 10/1963 | Benham | 49/386 |
| 3,113,649 | A | * | 12/1963 | Wargo | 49/239 |
| 3,134,134 | A | * | 5/1964 | Keator | 16/263 |
| 3,147,831 | A | * | 9/1964 | Tansey | 49/239 |
| 3,263,365 | A | | 8/1966 | Eckel | |
| 3,384,996 | A | * | 5/1968 | Gilchrist et al. | 49/383 |
| 3,545,032 | A | * | 12/1970 | Dielman | 16/263 |
| 3,546,736 | A | * | 12/1970 | Booth | 16/312 |
| 4,078,334 | A | * | 3/1978 | Lambias | 49/237 |
| 4,124,955 | A | | 11/1978 | Kochis | |
| 4,292,764 | A | * | 10/1981 | Kochis | 49/237 |
| 4,570,384 | A | * | 2/1986 | Eckel | 49/501 |
| 4,881,353 | A | * | 11/1989 | Braendel et al. | 52/239 |
| 4,951,351 | A | | 8/1990 | Eckel | |

* cited by examiner

*Primary Examiner*—Gregory J. Strimbu
(74) *Attorney, Agent, or Firm*—Pandiscio & Pandiscio

(57) ABSTRACT

A double-acting door closure device that automatically returns a double-acting door to a preferred center position comprises first and second members each having a helical end surface extending transversely of its center axis. The first member is secured in spaced relation to a door jamb and the second member is mounted on and secured to a door post that extends through and is rotatable in the first member, with the helical end surface of the second member facing and engaging the helical end surface of the first member. The helical end surfaces coact with one another to gravitationally return a door attached to the door post to a closed position automatically after the door has been pushed opened and then released.

5 Claims, 7 Drawing Sheets

AUTOMATIC DOOR CLOSURE FOR DOUBLE-ACTING DOORS

This invention relates to a mechanical door closure for double-acting doors and more particularly to a door in combination with a mechanical door closure.

BACKGROUND OF THE INVENTION

Mechanical door closure devices that automatically return a double-acting door to a preferred center position are well known and are exemplified by the mechanisms illustrated and described in U.S. Pat. No. 4,951,351, issued Aug. 28, 1990 to A. Eckel; U.S. Pat. No. 4,945,606, issued Aug. 7, 1990 to A. Eckel; U.S. Pat. No. 4,124,955, issued Nov. 14, 1978 to A. J. Kochis; and U.S. Pat. No. 3,263,365, issued Aug. 2, 1966 to O. C. Eckel. Such devices are generally satisfactory, but have limitations. For one thing, they are lacking aesthetically. For another thing they comprise a cam and cam follower, and the latter requires a roller in engagement with the cam in order to allow the door to pivot freely between open and closed positions. The roller is subject to breakdown. A further limitation of the foregoing type of closure device is that return motion to center position tends to be uneven due to the contour of the cam.

OBJECTS AND SUMMARY OF THE INVENTION

The primary object of the invention is to provide a new and improved cam/cam follower type mechanical door closure device.

A further object is to provide new cam-type door-closing hardware that is strong, durable, and reliable.

Another object is to provide a cam/cam follower type of door closure that is adjustable to assure that the attached door will close automatically to a determinate position.

Another object is to provide a gravitationally-operated door-closing mechanism that has simplicity of construction, can be installed with minimum skill, and can be substituted for other prior art cam/cam follower door closure devices.

The foregoing objects are achieved by providing a door closing system that comprises first and second members each having a central axially-extending bore for receiving a door post and a helical end surface extending transversely of its center axis. The first member is adapted to be secured in spaced relation to a side of a door frame with its central bore extending parallel to that door frame side. The second member is adapted to be mounted on and secured to a door post that extends through and is rotatable in the central bore of the first member, with the helical end surface of the second member facing and engaging the helical end surface of the first member. The helical end surfaces coact with one another to gravitationally return a door attached to the door post to a closed position automatically after the door has been pushed opened and then released. Other features and advantages of the invention are described in or rendered obvious by the following detailed description of a preferred embodiment of the invention and the accompanying drawings.

THE DRAWINGS

In the several views like components are designated by like numerals.

DETAILED DESCRIPTION OF THE INVENTION

Figure 1:
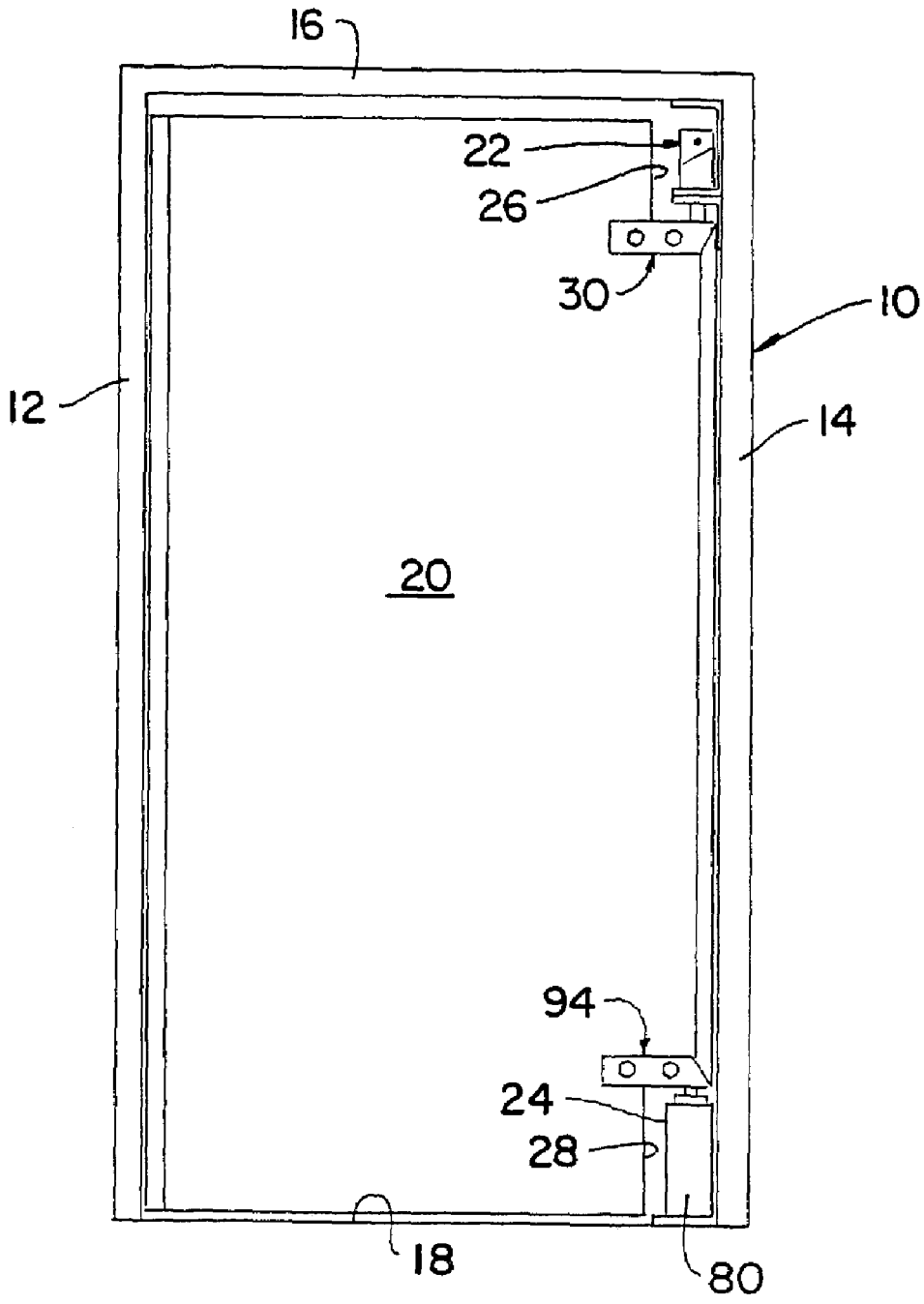
FIG. 1 is a full face view in elevation of a door mounted with cam-type hardware constructed according to the present invention.

Referring to FIG. 1, there is illustrated a door frame 10 comprising an outer jamb 12, and inner jamb 14, a lintel 16 and a sill 18. Hung in the door frame is a door 20. The door is attached by an upper door mount identified generally by the numeral 22 and a lower door mount identified generally by the numeral 24. The portion of the door adjacent to jamb 14 is notched as shown at 26 and 28 to accommodate the upper and lower door mounts.

Referring to FIGS. 2–4 and 11, the upper door mount comprises a metal door bracket 30 of U-shaped cross-section that straddles a portion of the door in the region of notch 26 and comprises a top plate 32 that sits on a top edge of the notched section of the door and two side plates 34A and 34B that extend down along opposite sides of the door. Bracket 30 is secured to the door by suitable fastening means, e.g., by bolts 36 and nuts 38 that extend through the side plates 34A and 34B. Welded to top plate 32 is a round door post 40. The latter may be a hollow tube or a solid rod and is made of a metal such as ordinary steel or stainless steel.

Figure 4:
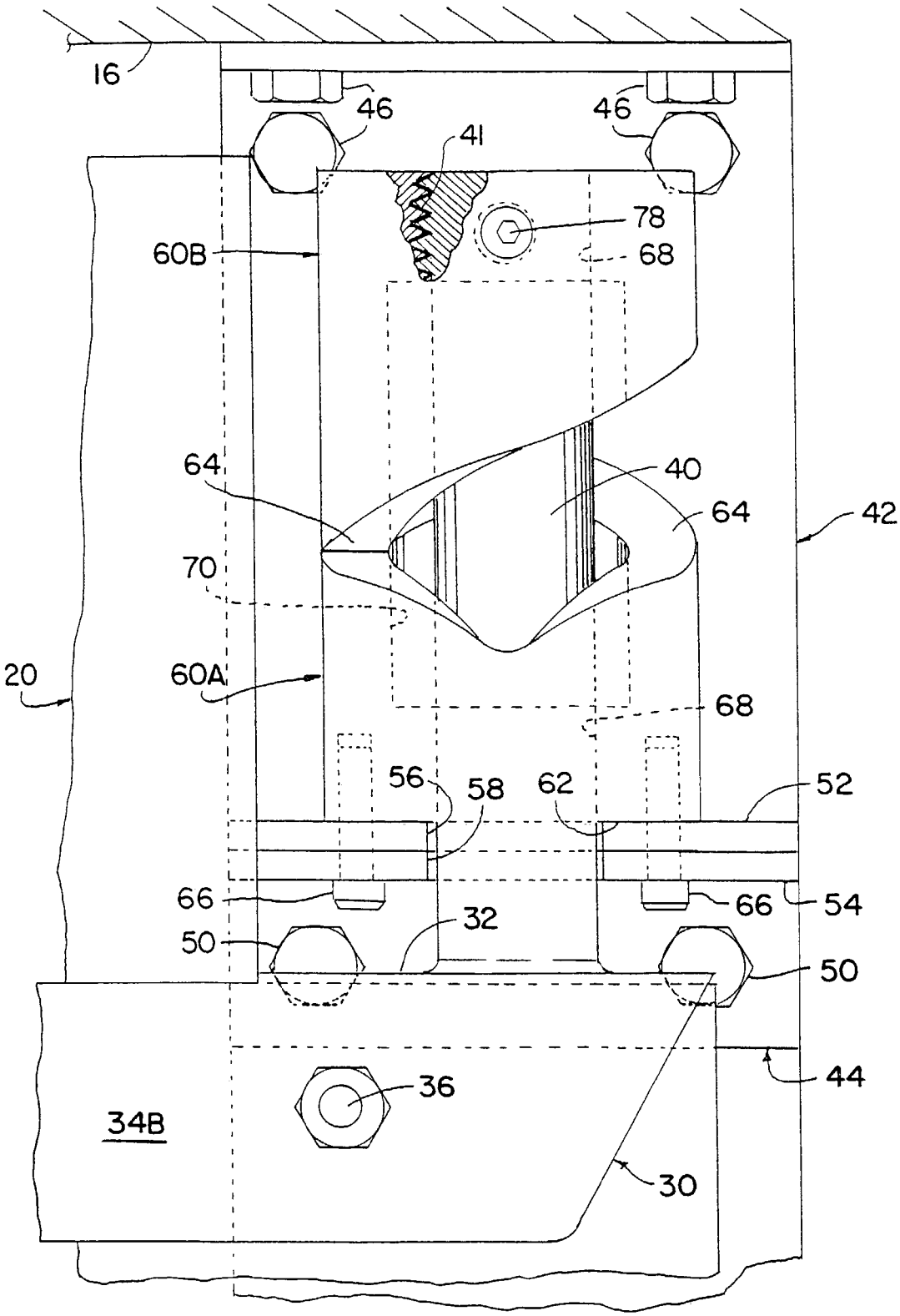
FIG. 4 is an enlarged fragmentary view in elevation taken from a viewpoint 90 degrees removed from that of FIG. 1 showing the cam-type hardware with the door in a fully open position.
Figure 11:
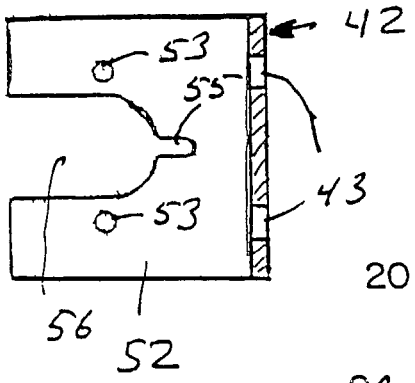
FIG. 11 is a sectional view of one of the support brackets for the cam hardware.
Figure 9:
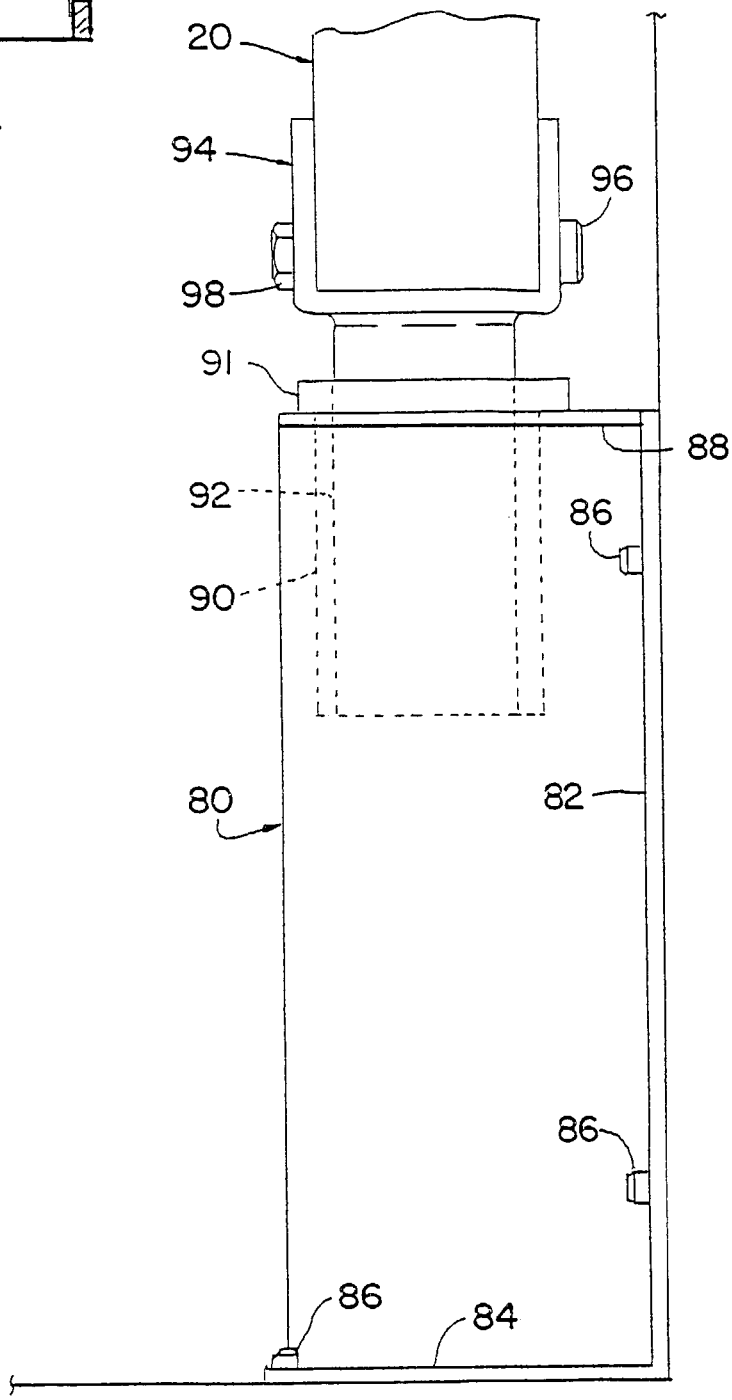
FIG. 9 is a fragmentary view in elevation like FIG. 8 but with the door in a fully open position.

The upper door mount also includes new cam-type door closure hardware comprising a first U-shaped metal bracket 42 and a second L-shaped metal bracket 44. The first bracket 42 fits in the upper corner formed by inner jamb 14 and lintel 16 and is fixed to those members by screw bolts 46. The second bracket is fixed to inner jamb 14 by additional screw bolts 50 and its horizontal arm 54 is spot welded to the horizontal arm 52 of bracket 42. Brackets 42 and 44 have holes, e.g., as shown at 43 in FIG. 11, to accommodate screw bolts 46 and 50. Referring to FIG. 4, the lower arm 52 of bracket 42 and arm 54 of bracket 44 are notched as shown at 56 and 58 to accommodate door post 40 without interfering with its rotation. Additionally, as shown in FIG. 11, arm 52 has two holes 53 and a slot 55 centered between holes 53 at the inner end of notch 56. Although not shown, it is to be understood that arm 54 of bracket 44 has like holes 53 and a like slot 55 disposed for alignment with the like elements of bracket 42.

Seated on lower arm 52 of bracket 42 is a first cam member 60A having at one end a flat surface 62 and at its other end an inclined helical cam surface 64 as hereinafter described in greater detail. The outer surface of cam member 60A is cylindrical. Cam member 60A is secured to bracket 42 by means of three screw bolts 66 that pass through aligned holes 53 and slots 55 in arms 52 and 54 and are screwed into tapped holes formed in the bottom end of the cam member. Cam member 60A has an axial bore 68 and a coaxial counterbore 70. The outer diameter of door member 40 is sized so that it makes a close but rotatable fit in bore 68. Counterbore 70 and the outer diameter of cam member 60A are sized so that the radial dimension of cam surface 64, measured between its inner and outer edges, is sufficient to assure a bearing surface that is adequate for supporting the weight of the door. By way of example but not limitation, cam member 60A has an outer diameter of about 2.375 inch, a diameter for bore 68 of about 1.250 to about 1.321 inch, a diameter for counterbore 70 of 1.500 inch, and a height of 2.500 inch measured between bottom surface 62 and the highest point of surface 64.

Figure 7:
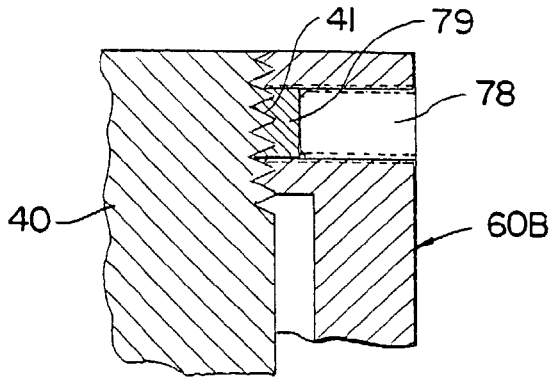
FIG. 7 is an enlarged fragmentary view of the upper cam member showing how it is secured in place.

The upper door mount also includes a second cam member 60B that is mounted on the upper end of door post 40 and functions as a cam follower. Except as otherwise described hereinafter, cam member 60B is identical to cam member 60A, but is oriented so that its helically curved end face 64 faces counterpart surface 64 of cam member 60A. The upper end of door post 40 is formed with an exterior screw thread 41 and the surface defining the axial bore 68 of cam member 60B has a slightly smaller diameter than axial bore 68 of cam member 60A, but is formed with a screw thread whereby it can be screwed onto the upper end of the door post. The rotational orientation of cam member 60B on door post 40 is fixed by means of a set screw 78 that is screwed into a tapped, radially-extending hole in the cam member. The set screw may engage the door post thread directly. However, that entails the risk that the set screw will deform the thread and make it difficult thereafter to unscrew the cam member of to alter its rotational position on the door post. Therefore, a preferred practice is to lock the cam member 60B to the door post by the combination of a set screw 78 and a brass plug 79 (FIG. 7) that is disposed between the inner end of the set screw and the door post thread. This preferred arrangement offers the advantage that the brass plug rather than the screw thread will deform under the pressure exerted by the set screw.

Figure 5:
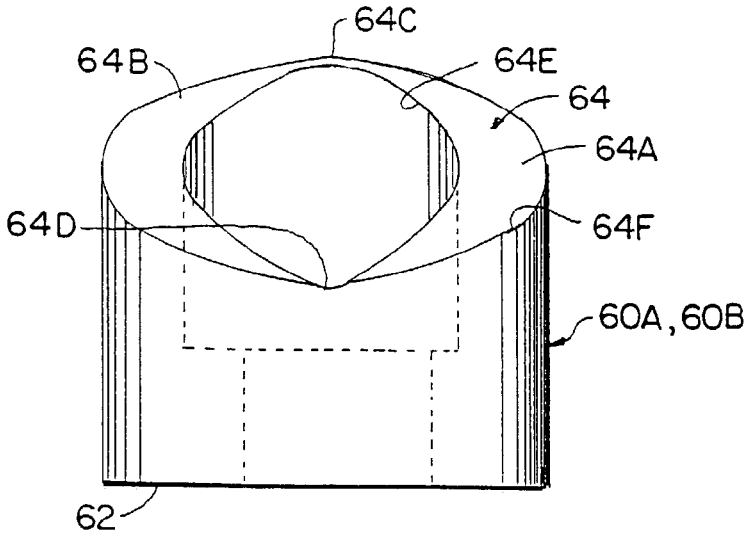
FIG. 5 is a view in elevation of one of the cam members of the cam-type hardware taken from the same viewpoint as that of FIG. 4.
Figure 6:
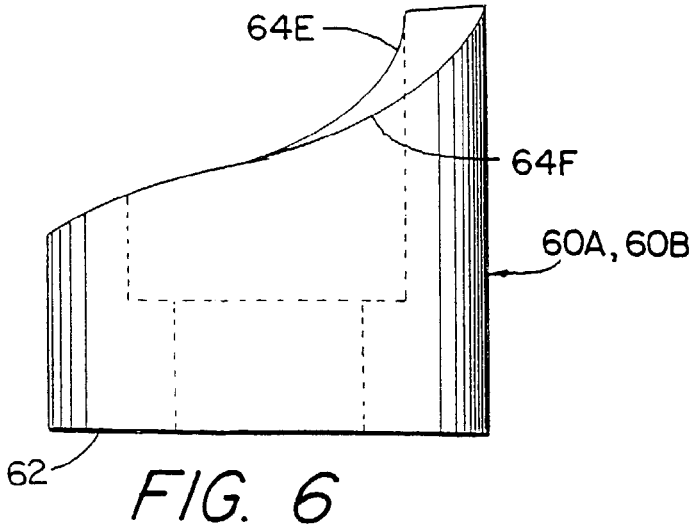
FIG. 6 is a view in elevation of one of the cam members taken from a viewpoint displaced 90 degrees from that of FIG. 5.
Figure 8:
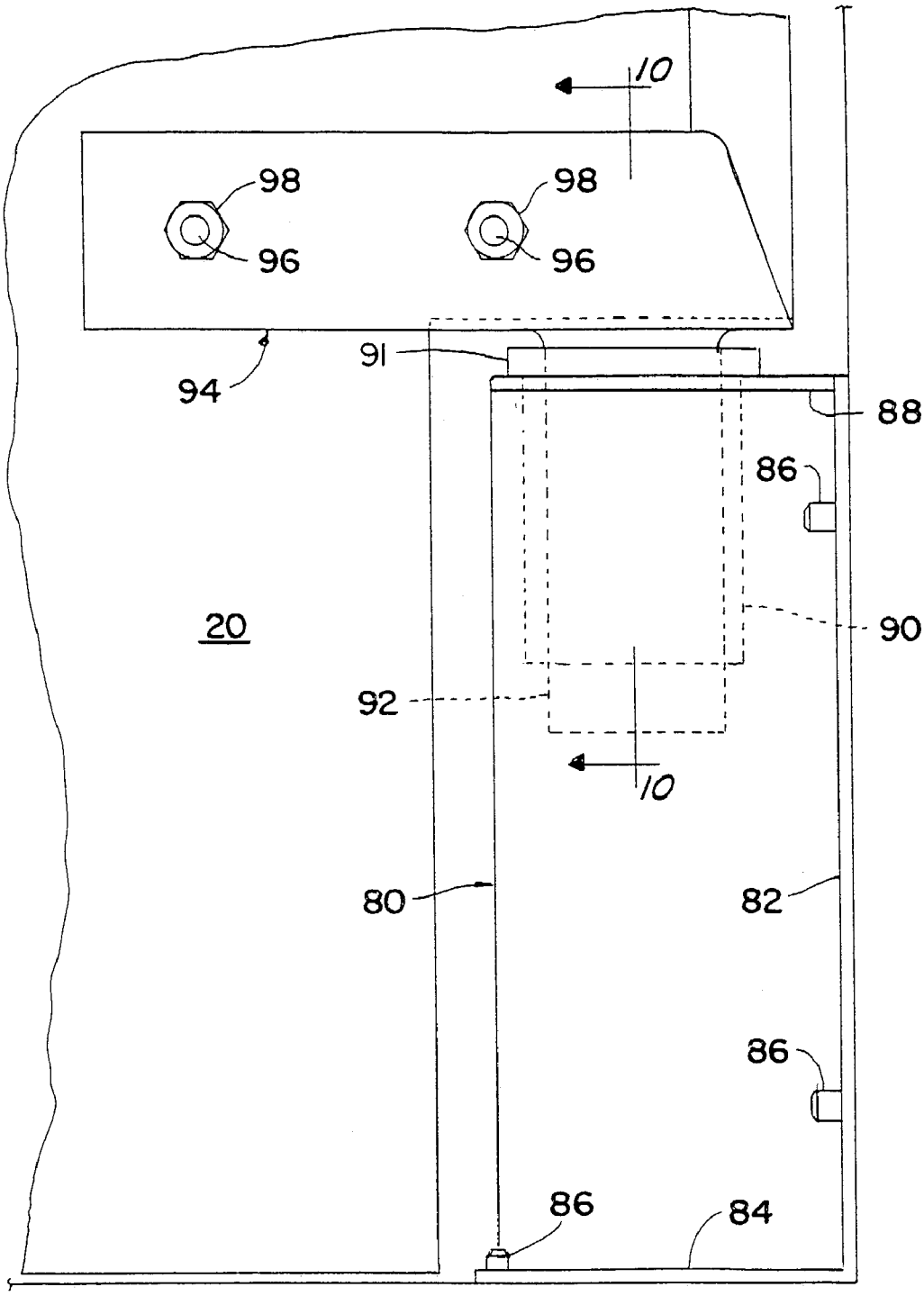
FIG. 8 is a fragmentary view in elevation illustrating a preferred bottom hinge connection for a door that is coupled to the new cam hardware.

Referring to FIGS. 2 and 4–6, the surfaces 64 of cam members 60A and 60B have a helical curvature and are flat between their inner and outer edges, with all co-radius points between those edges being equidistant from the corresponding flat end surfaces 62. As used herein with reference to surfaces 64, the term "helical curvature" denotes a helical curvature in relation to the longitudinal axis of the corresponding cam member, similar to the relationship of a screw thread to the axis of the shaft on which it is formed. As seen in FIGS. 4 and 5, the helically curved end surface 64 is effectively subdivided into two mirror halves 64A and 64B by a high point or top terminus 64C and a low point or bottom terminus 64D. The two surface portions 64A and 64B of each cam member are helically curved with the same pitch. The top terminus is a narrow flat surface area. The bottom terminus is also a narrow flat surface area. More specifically as illustrated in FIGS. 4 and 5, the two mirror halves of surface 64 come together to form a valley or dwell at the bottom terminus 65D. By way of example but not limitation, if cam members 60A and 60B each have an overall length of 2.500 inches, their helical surfaces 64 may be cut so that the axial distance between their top terminus and their bottom terminus is about 1.50 inches.

Referring now to FIGS. 1 and 8–10, the bottom mount comprises a U-shaped bracket 80 having two oppositely and outwardly extending side flanges 82 and bottom flanges 84 (only one each of flanges 82 and 84 is visible in the drawings) that are secured to inner jamb 14 and sill 18 by screw bolts 86. Welded to the upper end of bracket 80 is a top plate 88. Fixed in a hole in plate 88 is a tubular bearing 90 having peripheral flange 91 that engages plate 88. The latter rotatably accommodates a door post 92 that is a fixed extension of a U-shaped metal door bracket 94 that is similar to door bracket 30. Bracket 94 embraces opposite sides of door 20. The bracket is attached to door 20 by means of bolts 96 that extend through the door and are secured by nuts 98. The upper and lower door mounts are attached to the door so that door post 92 is axially aligned with door post 40.

Figure 2:
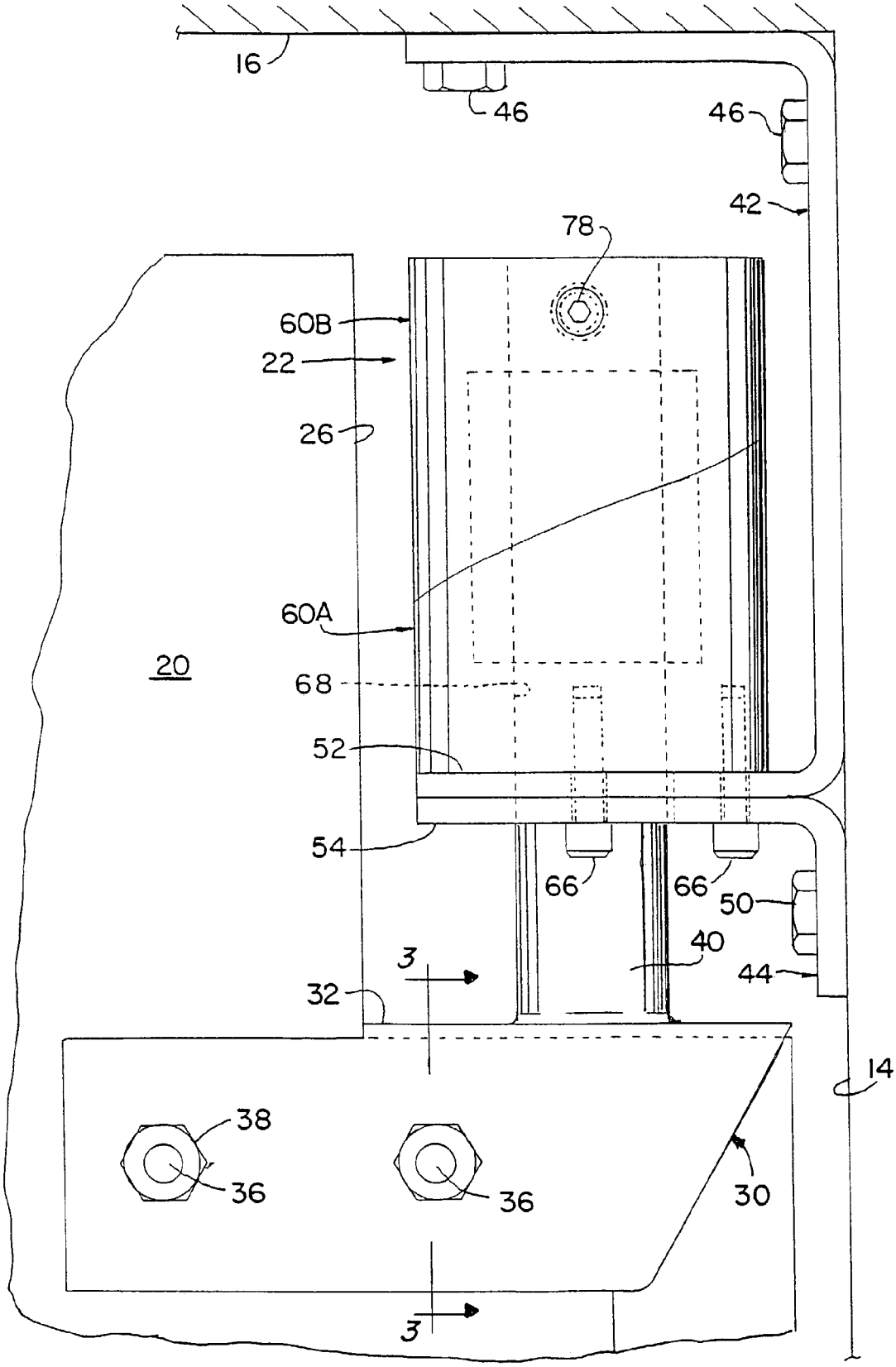
FIG. 2 is an enlarged fragmentary view in elevation of the cam-type hardware taken from the same viewpoint as FIG. 1.
Figure 3:
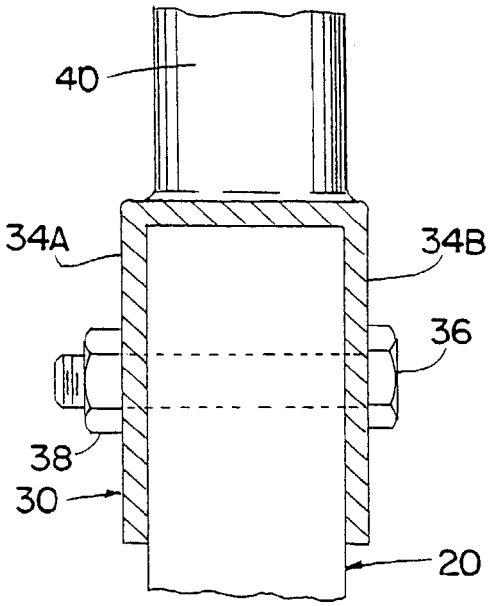
FIG. 3 is a fragmentary sectional view taken along line 3—3 of FIG. 2.
Figure 10:
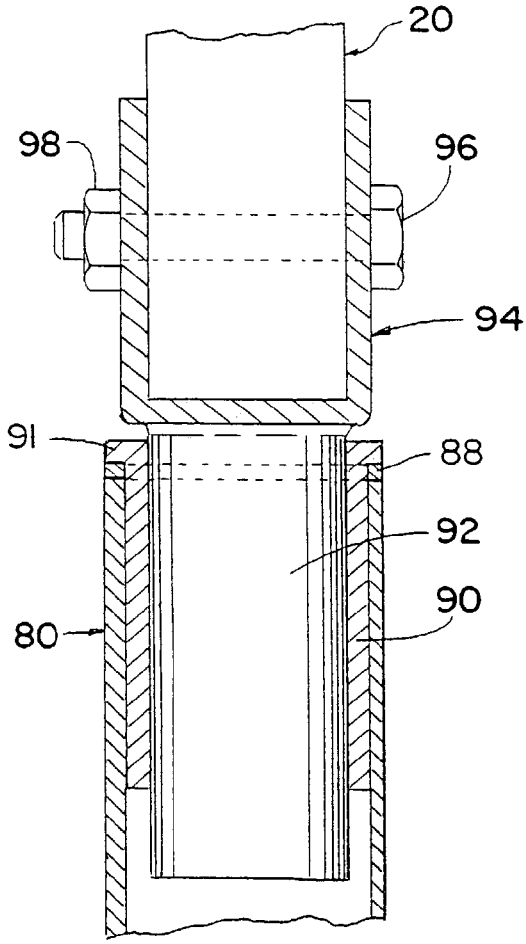
FIG. 10 is a sectional view taken along line 10—10 of FIG. 8.

Mounting the door is facilitated by the slots 56 and 58 in bracket arms 52 and 54. The door installation involves first attaching mounting brackets 42 and 44 and bracket 80 to the door frame as shown in the drawings. Then with brackets 30 and 94 attached to door 20, the bottom door post 92 is inserted in bearing 90 and door post 40 is moved into the slots 56 and 58 of brackets 42 and 44 respectively. Cam member 60A is then slipped onto upper door post 40 and attached to brackets 42 and 44 by means of screws 66. Alternatively and preferably, the rear screw 66 (the screw to the right in FIG. 2) may be attached to cam member 60A before the latter is moved into position over arm 52 of bracket 42, after which the cam can be shifted to the desired position and screw 66 tightened to lock the cam member to the two brackets. The two other screws 66 may be applied to secure the cam member in place. It is to be noted that the screw holes in the bottom of cam member 64A and the matching through holes in brackets 42 and 44 are located so as to assure that the cam member will be secured with its dwell point 64D in the 6 o'clock position using the side jamb 14 as a reference 12 o'clock position. Then top cam member 60B is secured to door post 40 with its high point 64C aligned with dwell point 64D of cam member 60A and its surface 64 fully engaged with the corresponding surface 64 of cam member 60A, as shown in FIG. 2. Thereafter the set screw 78 is tightened to lock cam member 60B to door post 40 via the brass plug 79. When this has been accomplished, the door will be in closed position, extending at substantially a right angle to the plane of side jam 14. If subsequently the door is pushed open in either direction, cam member 60B will ride up on the surface 64A or 64B of cam member 60A, causing the door to rise as it is turned. When the door is released, it will automatically return under the influence of gravity to its center at-rest or closed position. Because of the fact that the surfaces 64 of cam members 60A and 60B have identical helical contours, in all open positions of the door those surfaces make a least a line contact with one another for the full distance between their inner and outer edges which are identified in FIG. 5 as 64E and 64F respectively.

If the door is not exactly in fully closed position when at rest, i.e., when the cam members are as shown in FIG. 2, the set screw 78 may be loosened and cam member 60B rotated on door post 40 in the direction and by the amount required to position the door so that it extends perpendicular to side jamb 14, after which the set screw is tightened to lock cam member 60B to the door post. The extent to which the door may be swung open in either direction is determined by engagement of the door with a door stop (not shown) that may be a wall-mounted or floor-mounted device. Alternatively the door stop may be attached to the bottom mount bracket 80 or top mount bracket 44. Preferably the door stop is set to allow the door to swing open more than 90 degrees from its closed position, so as to maximize the pass-through opening between the door and the opposite doorjamb 12.

The two cam members may be made of various materials, e.g., a metal such as steel or aluminum or a plastic or fiber-reinforced plastic. A primary requirement of the cam members is that they be strong enough to carry the weight of the door. Preferably the bottom cam member 60A is made of Delrin®, a product of E.I. DuPont de Nemeurs Company, while the upper cam member is made of Teflon®-impregnated hardcote anodized aluminum. The Teflon® impregnation reduces the coefficient of friction of the aluminum and the tendency of dirt or other materials to adhere to the cam member, thereby assuring satisfactory operation of the door closure hardware. As a second preference, the upper cam member is also made of Delrin®.

The invention is susceptible of other modifications. Thus, for example, the two short door posts may be replaced with a single door post that extends for substantially the full length of the door, e.g., in the manner disclosed in U.S. Pat. No. 4,951,351, cited supra. Also the invention may be practiced by using other means for attaching the cam hardware components to the door frame and the door post, and the number and type of screws or other fasteners used in connection with the cam hardware may be varied. The arm 54 of bracket 44 need not be spot welded to arm 52 of bracket 42. Another modification is to replace U-shaped bracket 42 with an L-shaped bracket that is attached to the side door jamb but not to the lintel. A further modification comprises installing the door closure hardware as part of the bottom mount instead of as part of the top door mount. Alternatively two sets of the same cam hardware may be used for a single door, one set as part of the top door mount and the other set as part of the bottom door mount. Also, although the illustrated embodiment comprises a single door in a door frame, the door closure hardware provide by this invention may be used in installations comprising double doors, i.e., two swinging doors mounted side by side in a single door frame. In this connection it should be noted that an important advantage of the cam hardware described herein is that it may be used for relatively heavy duty doors, e.g., doors in a warehouse. A further advantage is that it eliminates the need for the roller that is necessary in all "V" cam door closure hardware used on double acting traffic doors, e.g., the hardware shown in U.S. Pat. Nos. 4,951,351, 4,945,606, 4,124,955, and 3,263,365, all cited supra. Still other modifications and advantages will be obvious to persons skilled in the art from the foregoing description and the related drawings.

What is claimed is:

1. In combination with a door having an upper end and a lower end and a door frame having a top end and a bottom end and comprising a side jamb, mounting means for pivotally attaching said door to said side jamb;

said mounting means comprising first and second cam members each having an inclined helically curved end surface, another end surface opposite said helically curved end surface, and an inner surface defining an axial through bore, a first bracket having flat opposite side surfaces and comprising a first portion having one of its flat side surfaces facing and extending parallel to said side jamb and a second portion that extends at a right angle to said first portion, said second portion of said first bracket having an opening therein, means for securing said first portion of said bracket to said side jamb adjacent said top end of said door frame, at least two screws releasably securing said first cam member to said second portion of said first bracket with said inclined helically curved end surface of said first cam member facing up, said at least two screws extending through holes in said second portion of said first bracket into threaded holes in said another end surface of said first cam member, said first cam member being spaced from said side jamb, a first door post, means for securing said first door post to said door adjacent said upper end of said door, said first door post extending vertically through and being rotatable in said opening in said second portion of said first bracket and said axial bore of said first cam member, said first door post having an upper end that projects above said helically curved end surface of said first cam member, screw means securing said second cam member to said upper end of said first door post with said inclined helically curved end surface of said second cam member confronting and engaging said inclined helically curved end surface of said first cam member, said screw means comprising a first screw thread on said upper end of said first door post engaged with a second screw thread on said inner surface of said second cam member, and means for locking said second cam member to said first door post; and said mounting means further comprising a second door post, means for securing said second door post to said door in spaced relation to and in coaxial relation with said first door post, a second bracket attached to said side jamb adjacent the bottom end of said door frame, and means for rotatably coupling said second door post to said second bracket.

2. The combination defined by claim 1 further including a third bracket comprising a first portion attached to said side jamb and a second portion extending at a right angle to said first portion of said third bracket, said second portion of said third bracket being engaged with said second portion of said first bracket, and further wherein said at least two screws extend through said second portion of said third bracket and secure said second portion of said third bracket to said second portion of said first bracket.

3. The combination defined by claim 2 wherein said first door post extends through an opening in said second portion of said third bracket.

4. In combination with a door having an upper end and a lower end and a door frame having a top end and a bottom end and comprising a side jamb, mounting means for pivotally attaching said door to said side jamb;

said mounting means comprising first and second cam members each having first and second opposite end surfaces and an inner surface defining an axial through bore, said first end surfaces of said first and second cam members each having an inclined helical curvature, a bracket having flat opposite side surfaces and comprising a first portion having one of its flat side surfaces facing and extending parallel to said side jamb and a second portion that extends at a right angle to said first portion and has an end facing away from said first portion, said second portion having a slot at said end thereof, means for securing said first portion of said bracket to said side jamb adjacent said top end of said door frame, at least one screw releasably securing said first cam member to said second portion of said bracket with said inclined helically curved first end surface of said first cam member facing up, said at least one screw extending through a hole in said second portion of said bracket and threadably secured in a hole in said second end surface of said first cam member, said first cam member for being spaced from said side jamb, a door post, means securing said door post to said door said door post extending vertically through said slot in said second portion of said bracket and through said axial bore of said first cam member, said door post being rotatable on its longitudinal axis relative to said second portion of said bracket and said first cam member and having an upper end that projects above said first end surface of said first cam member, said axial bore of said second cam member and said upper end of said door post having first and second mating screw threads respectively formed thereon and said second cam member being mounted on said upper end of said door post by a screw connection comprising engagement of said second mating screw thread with said first mating screw thread, said second cam member being oriented so that its first end surface confronts and engages said first end surface of said first cam member, and means carried by said second cam member and engageable with said second mating screw thread for releasably locking said second cam member to said door post.

5. The combination of claim 4 wherein said door post extends a distance less than the length of said side jamb and is secured to said door adjacent said upper end of said door, and wherein said mounting means further includes a second door post attached to said door adjacent said lower end of said door; said second door post being coaxial with said first door post and extending for a distance less than said length of relative to said side jamb, and means for rotatably coupling said second door post to said side jamb.

* * * * *

UNITED STATES PATENT AND TRADEMARK OFFICE

CERTIFICATE OF CORRECTION

PATENT NO. : 6,990,772 B2
DATED : January 31, 2006
INVENTOR(S) : Alan Eckel

It is certified that error appears in the above-identified patent and that said Letters Patent is hereby corrected as shown below:

Column 7,
Line 5, delete "for";
Line 6, insert -- for -- after "means"; and insert -- , -- after "door";

Column 8,
Line 13, delete ";" and insert -- , --; and
Line 15, delete "relative to".

Signed and Sealed this

Eleventh Day of April, 2006

JON W. DUDAS
*Director of the United States Patent and Trademark Office*